United States Patent [19]

Gaspard

[11] 3,948,060

[45] Apr. 6, 1976

[54] AIR CONDITIONING SYSTEM PARTICULARLY FOR PRODUCING REFRIGERATED AIR

[76] Inventor: Andre Jean Gaspard, 29 rue de l'Alma, Noumea (Nouvelle Caledonie), France

[22] Filed: Nov. 29, 1974

[21] Appl. No.: 527,959

Related U.S. Application Data

[63] Continuation-in-part of Ser. No. 361,893, May 21, 1973, abandoned.

[30] Foreign Application Priority Data

May 24, 1972 France ..... 72.18515

[52] U.S. Cl. ..... 62/175; 62/196

[51] Int. Cl.² ..... F25B 1/10

[58] Field of Search ..... 62/510, 196, 19 T, 200, 62/217, 511, 175; 236/1 E

[56] References Cited

UNITED STATES PATENTS

| | | | |
|---|---|---|---|
| 1,803,074 | 4/1931 | Schickler | 62/511 X |
| 2,237,574 | 4/1941 | Persons | 62/510 |
| 2,274,336 | 2/1942 | Lammers, Jr. | 62/510 |
| 2,363,273 | 11/1944 | Waterfill | 62/196 |
| 3,456,455 | 7/1969 | Sapir | 62/223 |

*Primary Examiner*—William E. Wayner
*Attorney, Agent, or Firm*—Kinzer, Plyer, Dorn & McEachran

[57] ABSTRACT

The invention relates to an air conditioning system for producing refrigerated air, comprising as many evaporator convectors as there are rooms to be air-conditioned, each evaporator being connected by means of supply and return pipes, to a condensation unit placed outside the rooms that are to be air-conditioned.

5 Claims, 1 Drawing Figure

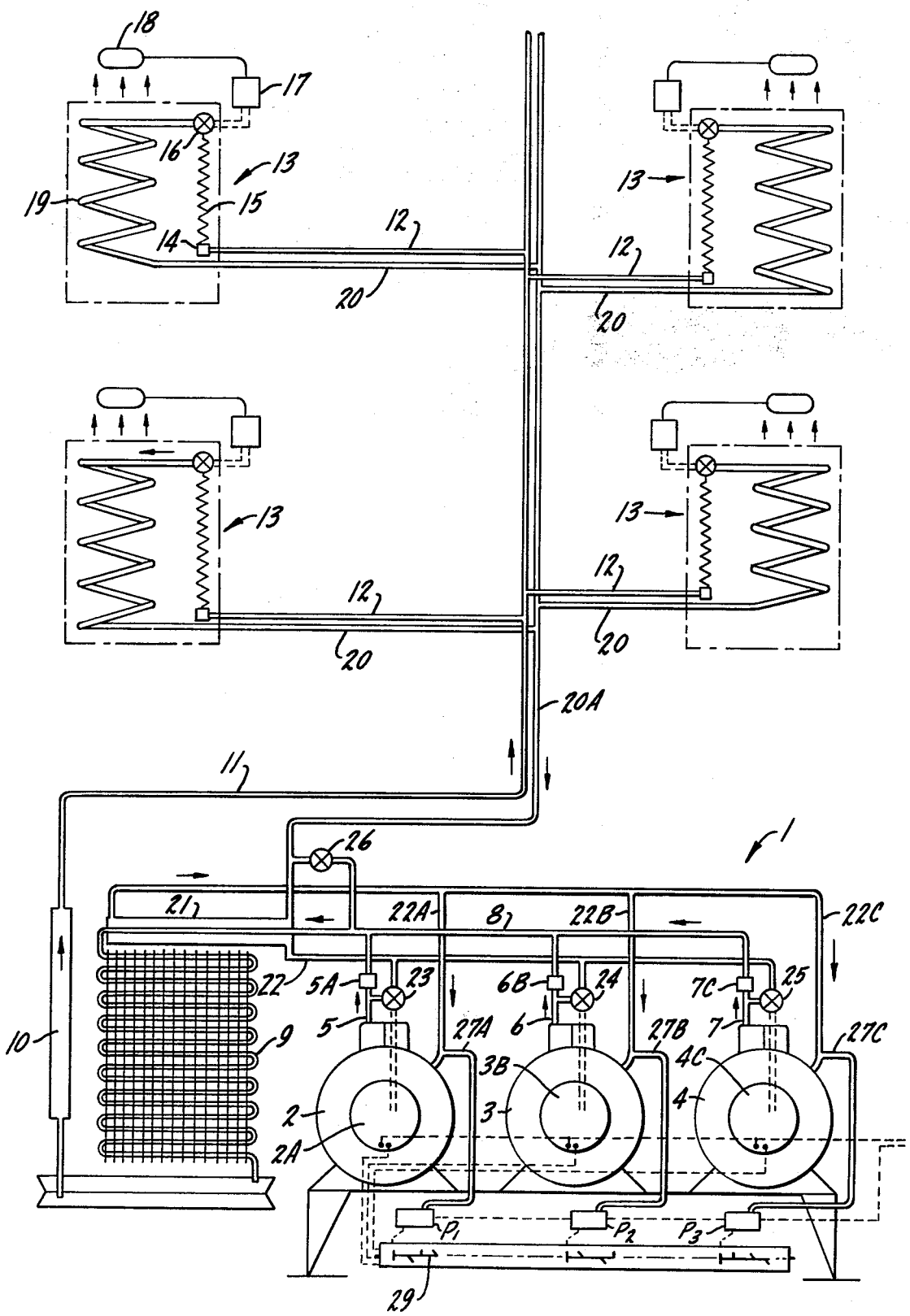
18
17
16
13
19
15
14
12
20
13
12
20
13
12
20
13
12
20
20A
11
26
1
21
22A
8
22B
22C
22
5A
23
6B
24
7C
25
10
9
5
27A
6
27B
7
27C
3B
4C
2
3
4
2A
P1
P2
P3
29

AIR CONDITIONING SYSTEM PARTICULARLY FOR PRODUCING REFRIGERATED AIR

This is a continuation in part of copending application Ser. No. 361,893, filed May 21, 1973, now abandoned.

SUMMARY OF THE INVENTION

The invention relates to an air conditioning system for producing refrigerated air, in particular for living rooms.

Various types of air conditioning systems are already known. The best known system consists of a central unit for producing cold air and supplying it, by means of pipes or ducts of large cross section, to the rooms that are to be air-conditioned. These pipes or ducts cannot be fitted unless provision to that effect has been made in the construction of the house. The cost of the system is high and it is suitable only for treating large volumes of air.

Individual air conditioners are also known which are installed through a wall or on a window sill. Such equipment is very noisy, difficult to install, and air-conditions only one room at a time. To eliminate the inconvenience of the noises, the convector or evaporator is separated from the condensation unit but, in this method, only one volume of air can be treated by one such equipment.

Another type of air conditioning system is based on circulating cold water through several rooms from a central condensation unit. This system requires a cold water circulation pump as well as, to avoid condensation, an effective insulation of the pipes of large cross section along the whole of their length.

The object of the present invention is to overcome the disadvantages of the known systems. It relates, therefore, to this end to an air conditioning system for producing refrigerated air comprising several evaporators capable of air conditioning several rooms at different temperatures, each evaporator being connected, by means of supply and return pipes, to a condensation unit placed outside the rooms to be air-conditioned, a valve responding to the suction pressure of the system being fitted in a bypass connection between the delivery and the suction pipes of one or several compressors to maintain a constant pressure in the suction circuit, whatever the number of evaporators in operation, each evaporator being provided with a solenoid valve controlled by an ambient temperature thermostat to allow or stop the circulation of the refrigerant, the flow rate of which is controlled by a capillary tube, said solenoid valve being placed between the outlet of the capillary tube and the inlet of the evaporator.

BRIEF DESCRIPTION OF THE DRAWINGS

A system according to the invention is illustrated schematically in the single attached drawing.

DESCRIPTION OF THE PREFERRED EMBODIMENTS

Referring to the attached drawing, the system comprises a condensation unit designated by the general reference number 1. This condensation unit is located outside the various rooms to be air-conditioned. The condensation unit, in the example illustrated, includes compressors 2,3,4, which can be put into operation successively to meet the various needs of the system. Each of the compressors 2, 3 and 4, comprises an output pipe, respectively 5,6,7, opening out into a delivery pipe 8 which leads to the condenser 9, followed by a dehydrating filter 10, leading to a supply pipe 11 each of the subsidiary pipes 12 of which supplies the evaporators or convectors designated by the general reference number 13. The ends of the subsidiary branches 12 of the supply circuit are provided with a filter 14 connected to the inlet of a capillary tube 15, the outlet of which is controlled by a solenoid valve 16. The solenoid valve 16 is controlled by a thermostat 17, which responds to a detector probe 18, to allow or stop the refrigerant circulating in the circuit or coil 19 of the evaporator. The return of the refrigerant to the condensation unit is effected by means of pipes 20 connected to a return line 20A which leads to a heat exchanger 21.

The heat exchanger 21 communicates with each of the suction pipes 22A, 22B and 22C of the compressors 2, 3 and 4. Each compressor is fitted with a decompression valve 23,24,25 connected in parallel to the starting coil of each compressor motor 2*a*,3*b*,4*c*, so as to directly connect the suction circuit 22 of the compressor and the delivery pipes 5,6,7 which include back-pressure valves 5A,6B,7C.

According to another characteristic feature of the invention, an automatic pressure release valve or means 26 responding to suction pressure is provided, located in a bypass position, between the delivery pipes 5,6,7 of the compressors and the heat exchanger 21. The suction pipes 22A,22B,22C of the compressors each have a tap 27A,27B,27C which are each connected to low pressure pressostats $P_1$, $P_2$, $P_3$, regulated in order of increasing pressure. Each pressostat is connected to a switch 29.

The system operates in the following manner:

When one of the evaporators 13 comes into operation, its solenoid valve 16 opens the refrigerant liquid circuit. The pressure on the suction side of the compressor 2 rises and actuates the pressostat $P_1$ thereby starting up the compressor 2.

If this compressor is of a power greater than that which is needed, the suction pressure tends to diminish. The automatic pressure release means 26 reestablishes the pressure at a predetermined level, thereby preventing the evaporator 13 from frosting over.

As soon as the second evaporator 13 comes into operation, the suction pressure tends to rise again, and this acts upon the bypass automatic pressure release means 26 which opposes this variation of pressure by a closing action.

If the compressor 2 is sufficiently powerful, the operating cycle continues in that particular state.

If, on the other hand, the power of the compressor 2 is too small to deal with the flow of gas, the suction pressure rises a little more closing in the first place the automatic pressure release means 26, which causes the second compressor 3 to start up.

The governor valve 26 for the suction pressure of the system, linked with the compressors, maintains the suction pressure at a constant level, notwithstanding the number of evaporators in operation. Depending on what the needs are, the valve 26 either admits gas from the discharge side to the suction side, or totally closes.

The gas admitted from the high side or discharge side to the low side by the valve 26 passes through the heat exchanger 21, as does the gas coming from the evaporators on the suction side and from the relief valves 23, 24 and 25, when the compressors are put into operation. The heat exchanger 21, heated by the discharge gas which travels from the compressors to the condenser 9, enables the refrigerant returning from the evaporators, the regulator 26 and the relief valves, to reach the inlet of the compressors fully vaporized.

When the evaporators 13 stop, the reverse phenomenon takes place.

Each compressor is cut out successively.

When the last evaporator 13 has stopped, the pressure drops, despite the maximum opening of the bypass pressure release means 26, the output of which is less than the suction capacity of a single compressor.

When the cut out pressure of the pressostat $P_1$ has been reached, the entire system stops. In order to distribute the work equally between the various compressor motors, a switch 29 can be adjusted to easily reverse their operating order.

During the very short start-up period of the motor of each of the compressors 2,3,4, the electrical decompression valve 23,24,25, connected in parallel to the start-up coil of the motor 2A,2B,2C (for monophase motors) connects the suction pipe 22 to the delivery pipe 5,6,7.

The back-pressure valve 5*a*, 6*b* or 7*c*, as may be, isolates the compressors from the rest of the system.

As soon as the motor has reached its normal operating speed, the start-up coil and at the same time the decompression valve 23,24,25 are cut out.

The same applies to each of the compressors when they are required to operate.

One of the novel features of the invention rests in the fact that the installation, as described hereabove, comprises several evaporators and compressors working under a suction pressure stabilized by a regulator. The evaporators can work simultaneously or separately, stop and start again without any disadvantage notwithstanding duration of the stops or of the working periods.

The system according to the invention has a number of additional advantages. Since the condensation unit 1 which includes the compressor motor units 2A,3B,4C can be located at a distance from the convectors or evaporators in use, the system operates silently.

The installation of the system is very simple since it does not require any ducts for circulating cold air. Walls need to be pierced only for the purpose of allowing the passage of the delivery and suction pipes which, in this embodiment, are of very small cross section.

The system provides non-negligible savings in operating costs, as the motors operate only as required to meet the needs of the convectors or evaporators that are being used.

Of course, the invention is not limited to the example of its embodiment hereinabove described and illustrated. Other methods and embodiments can be envisaged without departing from the scope of the invention.

The embodiments of the invention in which an exclusive property or privilege is claimed are defined as follows:

1. In an air conditioning system for producing cool air, a pluraluty of evaporators to cool various rooms at different and variable temperatures, the evaporators being connected to each other in parallel by refrigerant supply and return lines, a condensation unit connected to the supply and return lines to be placed outside of the rooms to be cooled and including a plurality of compressors connected in parallel to the supply and return lines, means responsive to the pressure of the returning gaseous refrigerant in the return line to energize and deenergize the compressors at certain pressure levels in the return line so that the number of compressors in operation will be related to the heat load in the various rooms to be cooled, and a bypass between the discharge of the compressors and the return line with a control valve therein constructed to maintain the suction pressure at a generally constant level regardless of the number of evaporators operating.

2. The structure of claim 1 further characterized by and including a heat exchanger between the supply and return lines disposed so that the refrigerant passing through the bypass goes through the heat exchanger before returning to the compressors.

3. The structure of claim 1 further characterized by and including a heat exchanger between the supply and return lines disposed so that the bypass is connected to the supply line ahead of the heat exchanger.

4. The structure of claim 1 further characterized in that each evaporator has a solenoid valve controlled by ambient air temperature in its room to control the circulation of the refrigerant, and a capillary tube between the supply line and solenoid valve.

5. The structure of claim 1 further characterized in that each compressor has a bypass between its supply and return lines with an automatic decompression valve located therein to facilitate start-up of the compressor.

* * * * *